United States Patent [19]

Kittredge

[11] 4,421,977

[45] Dec. 20, 1983

[54] SECURITY SYSTEM FOR ELECTRONIC DEVICE

[75] Inventor: Lloyd G. Kittredge, Trumbull, Conn.

[73] Assignee: Pitney Bowes Inc., Stamford, Conn.

[21] Appl. No.: 399,595

[22] Filed: Jul. 19, 1982

[51] Int. Cl.[3] ..... G07G 1/00

[52] U.S. Cl. ..... 235/101; 235/130 R; 364/900

[58] Field of Search ..... 235/61 A, 101, 130 R, 235/1 D; 364/200, 900, 708

[56] References Cited

U.S. PATENT DOCUMENTS

| | | | |
|---|---|---|---|
| 3,938,095 | 2/1976 | Check, Jr. et al. | 364/900 |
| 3,978,457 | 8/1976 | Check, Jr. et al. | 364/200 |
| 4,097,923 | 6/1978 | Eckert, Jr. et al. | 364/900 |
| 4,202,489 | 5/1980 | Schubert | 235/101 |
| 4,340,809 | 7/1982 | Betcher | 235/101 |

*Primary Examiner*—Benjamin R. Fuller

*Attorney, Agent, or Firm*—Peter Vrahotes; Melvin J. Scolnick; Albert W. Scribner

[57] ABSTRACT

A secured housing for an electronic device having an electronic memory mounted therewithin is provided which has an access aperture which provides tamper proof security and electro-magnetic interference protection while permitting access to the memory for reading the information maintained in the memory. Opening of the access aperture disables the electronic device from further operation by unlatching a switch which disconnects the electronic device from its power supply while preventing relatching of the switch to reactivate the electronic device. Use of the access aperture provides a visible indication of access to the interior of the housing. In one embodiment of the invention, the electronic device is an electronic postage meter and the electronic memory is a nonvolatile memory containing postage accounting information.

10 Claims, 6 Drawing Figures

SECURITY SYSTEM FOR ELECTRONIC DEVICE

RELATED APPLICATIONS

This application is related to copending application Ser. No. 399,594 filed on even date herewith and entitled "ACCESSIBLE HOUSING FOR ELECTRONIC SYSTEMS" which is assigned to the assignee of the present invention. The specific and entire disclosure of the aforementioned application is specifically incorporated herein by reference for the purpose of further explaining the nature and operation of the present invention.

BACKGROUND OF THE INVENTION

This application relates generally to a security system for electronic devices and more specifically to a security system for an electronic calculating device such as an electronic postage meter.

Electronic postage meters are well known devices for imprinting postage impressions of desired value directly on an article to be mailed or on an adherent tape to be affixed to the article. Such meters commonly include a keyboard for the entry of postage information to be printed, a display for displaying postage information to be printed, one or more microprocessors and peripheral circuits for controlling various meter functions and operations including the entry of data to the registers and activation of a printing mechanism, an electronic accounting device including internal memory registers for maintaining accounting information and a printing mechanism for imprinting the postage information. The accounting information maintained in the memory registers may include a control total representing the total amount of postage paid for, an ascending balance representing the total amount of postage printed and expended and a descending balance representing the total balance of postage remaining.

Prior to using a meter, a user must purchase a fixed amount of postage from the postal service. The term "postal service" as used herein means either the United States Postal Service or an authorized private mail carrier. A postal service agent or employee alters the contents of the internal memory register to reflect the amount of postage paid for and sets or increases the control total and descending balance so as to reflect the total amount of postage purchased. In order to use the meter, the user selects a postage value to be imprinted and activates the postage printing mechanism. The postage meter may be used continuously until the descending balance reaches a pre-determined minimum (i.e. until the postage paid for has been exhausted or has reached a pre-determined minimum threshold value required for operation).

Since the accounting information represents the equivalent of money, it is apparent that stringent security safeguards are necessary to protect this information. In particular, the security safeguards must insure that all postage printed must be paid for. For this reason the printing actuating mechanism and the accounting registers are located within a secured housing and access thereto is restricted, in general, to postal service employees. Additional security in electronic postage meters is provided by programmed safeguards employed in the operation of the system. Such safeguards are shown and described in U.S. Pat. No. 3,938,095 issued Feb. 10, 1976 and U.S. Pat. No. 3,978,457 issued Aug. 31, 1976, both of which patents are assigned to the assignee of the present invention. European patent publication No. 0019515 published Nov. 26, 1980 also describes such safeguards. Such programmed safeguards do not form part of this invention and are not further described.

Electronic postage meters inherently rely for their operation on continuous electric power and interruption in such power including either a loss of electric power, a decrease in the electric power below a required minimum line voltage or a fluctuation in the power can threaten the security of electronic postage meters in at least two ways. First, the electronic memory registers which retain the accounting information usually require continuous power for their operation and thus a power interruption can result in a loss of accounting information. Second, a power interruption can affect the operation of the logic and control circuit elements within the meter such that their operation is erratic thus resulting in entry of erroneous data to the memory registers. Accordingly, as a further security safeguard, a separate and redundant set of memory registers in the form of a nonvolatile memory is provided, which nonvolatile memory does not rely on continuous power and thus retains the accounting information even though a power interruption occurs. Such nonvolatile memories may be inherently nonvolatile such as a semiconductor bubble memory or may rely on an auxiliary power source such as a battery. In this manner accounting data is maintained even in the event of a power interruption. As noted, the accounting information has a value similar to that of money and thus the accounting data maintained in the nonvolatile memory is maintained in a secured housing and may be accessed only by postal employees during normal operation.

When the descending balance reaches a pre-determined minimum, the postage meter must be recharged, that is control data and descending register data must be reset to reflect an increase in the amount of postage paid for. This is done at the postal service facility by postal service agents or employees or by a remote resetting mechanism such as that shown and described in U.S. Pat. No. 4,097,923 issued June 27, 1978 and assigned to the assignee of the present invention.

Access to the accounting information is provided through the keyboard or display circuit and through an auxiliary communication channel accessible by an electronic probe connector. However, in view of the security safeguards required as noted above, the access to the accounting information contained in the registers must be made at a postal service facility. As a result, a problem occurs where a malfunction in a meter occurs in circuits peripheral to the nonvolatile memory such as the microprocessor control circuits, power supply or isolation circuits. In such a case immediate access to the memory registers is not possible at the postal service location and the meter must be returned to a repair facility for repair prior to subsequent read out of the postage funds balance from the register at a postal service facility. As a result a substantial period of time elapses during which the customer does not have access to the postage funds he has paid for and which remain on his control total and descending balance in the registers contained in his inoperative meter. It would be desirable to access the accounting information in the event of such a malfunction and transfer it immediately into a replacement meter thus providing the customer with substantially immediate access to his postage funds balance.

Accordingly, an auxiliary communication channel is provided containing read access lines to the nonvolatile memory. Access to this communication channel is provided through a sealed access aperture or door, which provides tampering and electromagnetic interference protection, but is designed for operation on a single occasion only. Access through the door precludes further normal meter operation by deactivating the meter in such a manner that reactivation is not possible without destruction of the meter housing. Thus, the customer has immediate access to his postage funds while protection of the data and prevention of unauthorized alteration of the postage funds balance as well as unauthorized use of the meter and in particular its printing mechanism is achieved.

It will be understood that, although the present invention is described in conjunction with a preferred electronic postage meter embodiment, the invention is applicable to other electronic calculating devices employing a secured housing enclosing and preventing access to an electronic control circuit and nonvolatile memory containing accounting data such as voting machines, parimutual machines, and electronic franking machines.

SUMMARY OF THE INVENTION

Briefly stated, and in accordance with one embodiment of the present invention, there is provided an electronic postage meter having a secured housing which encloses a nonvolatile memory containing accounting information and an access aperture designed for use on a single occasion. The aperture is an integral part of the secured housing and provides both tamper proof security and electromagnetic interference protection as does the secured housing itself. Use of the one time access aperture permits electronic probing of the nonvolatile memory for reading out the accounting information contained therein but precludes providing means for writing additional or changed information into the nonvolatile memory and provides a visible indication that the aperture has been accessible. Further, the opening of the access aperture operates a switch which disables the meter from further normal operation.

BRIEF DESCRIPTION OF THE DRAWINGS

Other objects and advantages of the present invention will become apparent upon a reading of the following detailed description and upon reference to the drawings wherein.

While the present invention will be described in connection with a preferred embodiment thereof, it will be understood that it is not intended to limit the invention to that embodiment only. On the contrary, it is intended to cover all alternatives, modifications and equivalents as may be reasonably included within the spirit and scope of the invention as defined by the appended claims.

DETAILED DESCRIPTION OF THE INVENTION

Figure 6:
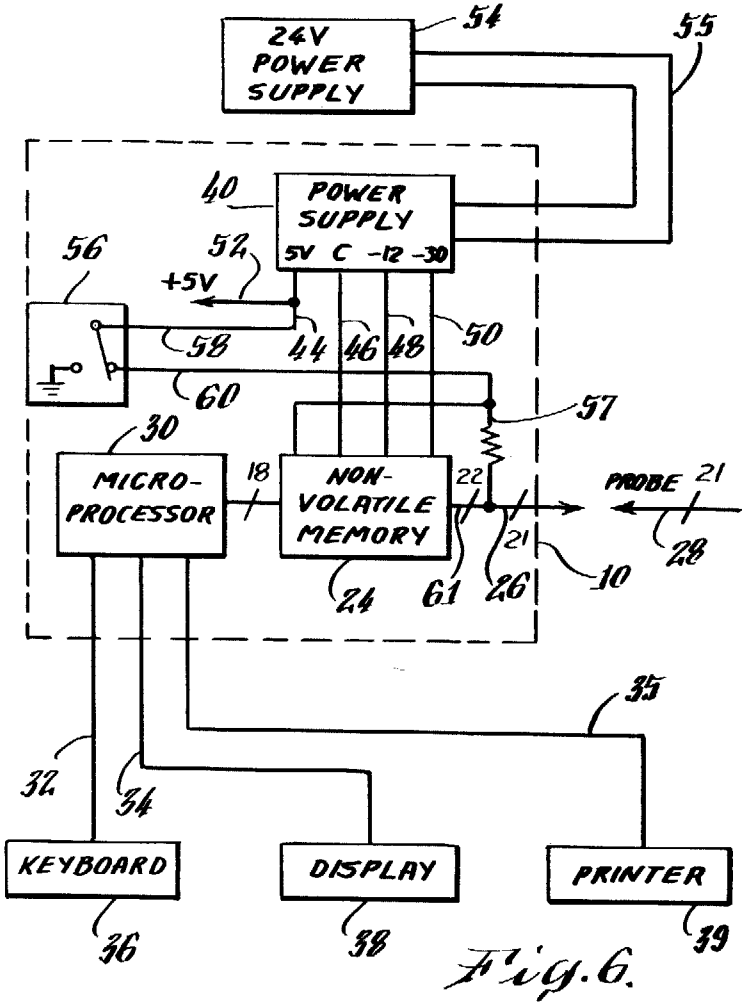
FIG. 6 is a schematic showing of the circuit employed in the postage meter embodiment of this invention.
Figure 1:
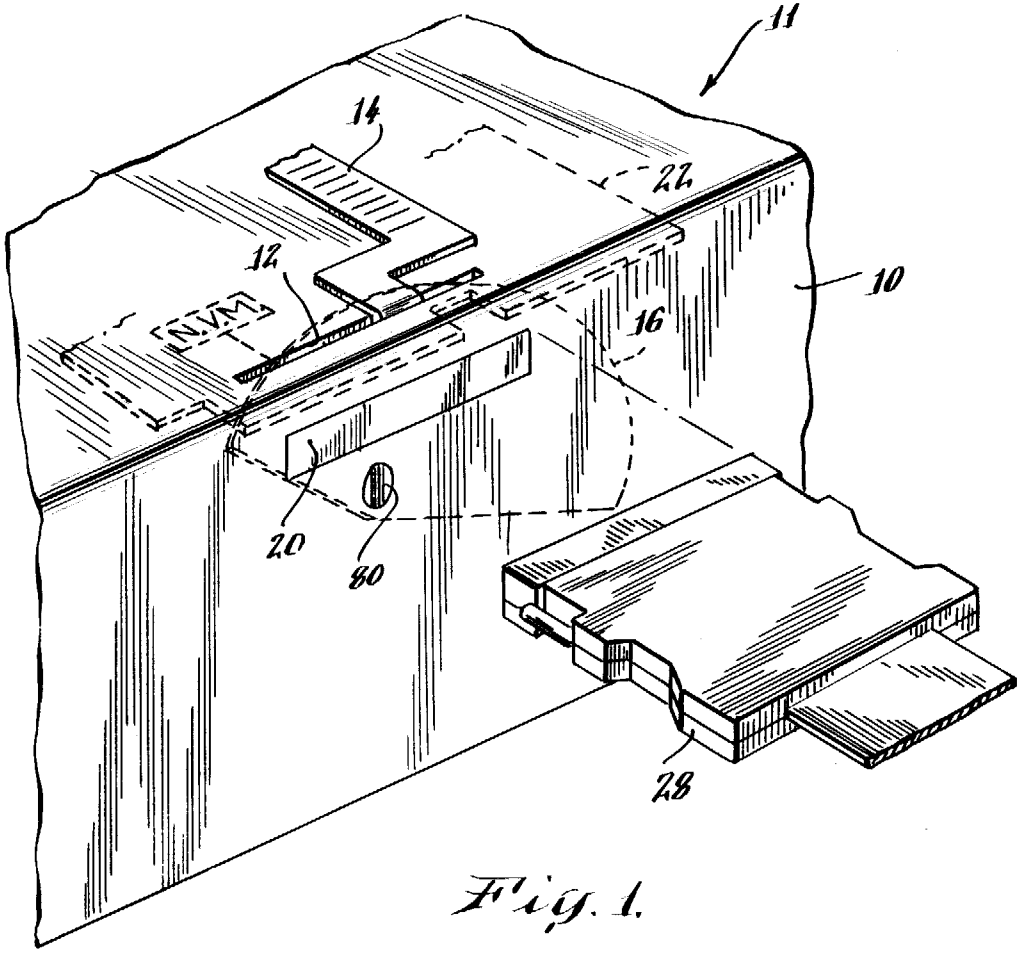
FIG. 1 is a perspective, partially broken, view of the exterior of a secured housing employed in the present invention.
Figures 2, 3, 4, 5:
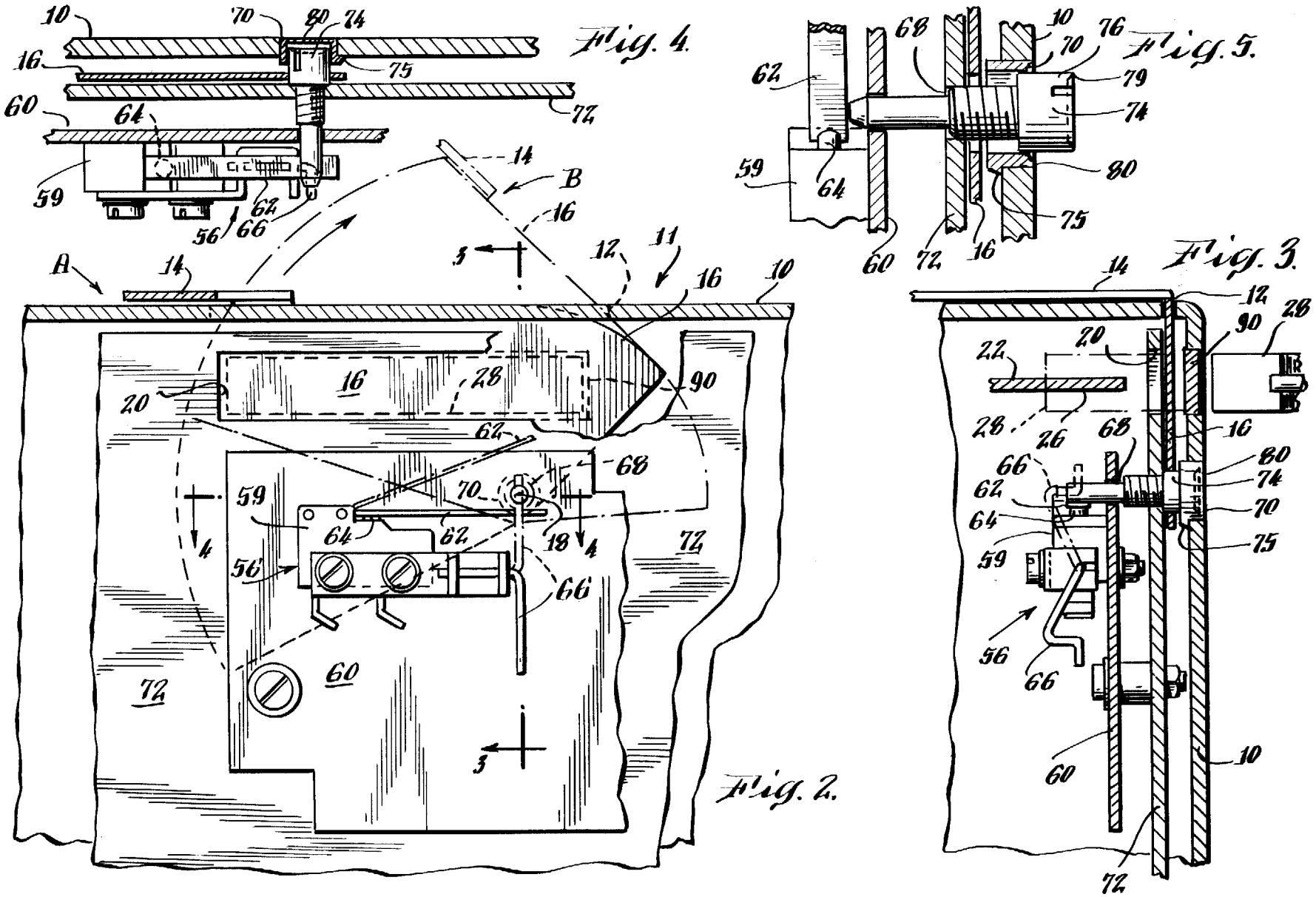
FIG. 2 is a detailed showing of a portion of FIG. 1 and including a switch employed in the present invention.
FIG. 3 is a section of FIG. 2 taken on line 3—3.
FIG. 4 is a section taken on line 4—4 of FIG. 2.
FIG. 5 is a detailed showing, partially in section, of a sub-assembly employed in the present invention.

Referring now to the drawing, particularly FIGS. 1 and 2, there is shown, in a preferred embodiment of this invention, a portion of an electronic postage meter 11 having a secured exterior housing 10. The housing 10 is designed to provide security from tampering including unauthorized access to the interior of the housing where accounting information is retained in a nonvolatile memory 24 and where microprocessor control circuits 30 may be actuated as will be explained in further detail later (FIG. 6). Further, the housing provides protection from electromagnetic interference for the electronic components contained within housing 10.

Housing 10 includes a slot 12 through which protrudes the operating end of a carrying handle 14. Integral with the handle 14 is a shutter blade 16. The handle 14 including shutter blade 16 is pivotable about a point 18 between a first position "A" where the operating end of handle 14 nests against housing 10 and an extended position "B" where operating end of handle 14 is in an operating position permitting lifting of the housing 10 and its contents. It will be noted that shutter 16 has an arcuate shape such that it blocks access through aperture 20 in housing 10. The shuttering of aperture 20 occurs when the operating end of handle 14 is in the "A" position, the "B" position or in any intermediate position (such as that shown in FIG. 1).

Mounted within housing 10 is a printed circuit board 22 having a nonvolatile memory 24 mounted thereon. An electrical communication channel 26 from nonvolatile memory 24 is provided on printed circuit board 22 and shown in the form of lead lines directed toward aperture 20. Aperture 20 provides access to communication channel 26 for an electronic probe connector 28 which electrically engages communication channel 26 in a male-female connection to provide electrical access to the register of nonvolatile memory 24.

Referring to FIG. 6, an electronic postage meter 11 is shown schematically including secured housing 10 within which is enclosed a microprocessor control circuit 30, nonvolatile memory 24 and power supply 40. External to the housing 10, and in electrical communication therewith through circuit connections 32, 34 and 35, which may include optical isolation circuits, not shown, are keyboard 36, display 38 and postage printer 39, respectively.

As shown in FIG. 6 the power supply 40 supplies various voltage levels to elements of the microprocessor control circuit 30, the nonvolatile memory 24, and through 5 volt outlet 52, to other peripheral circuits, not shown, through connections 44, 46, 48, and 50 respectively. Electrical connection of power supply 40 to the electronic elements of postage meter 11 is controlled through switch 56 which controls electrical connections 58 and 60. Power supply 40 may also be connected to an external power supply 54 through isolation circuit 55.

Nonvolatile memory 24 includes a multiple lead output channel 61 connected to a multiple output communication channel 26 which is accessed through the exterior of housing 10 by electrical connector probe 28.

Probe 28 accesses the read lines only of nonvolatile memory 24 and thus communication channel 26 is shown to include 21 lead lines or one less than the 22 lead lines shown for channel 61 (see FIG. 6) The additional lead line which exits from channel 61 is lead 57 which includes the write lines for memory 24. Thus accessing of communication channel 26 by probe 28 permits readout of the contents of the registers of nonvolatile memory 24 only, while the capability of writing in or changing the information contained in nonvolatile memories 24 is precluded when accessing memory 24 through probe 28.

Referring now to FIGS. 2–5, there is shown a switch assembly 56 which includes a limit switch 59 mounted on circuit board 60. Switch 59 includes a spring loaded lever arm 62 which, in the solid line position shown in FIG. 2, depresses a contact button 64 which maintains the switch 59 in a closed circuit configuration. In the dotted line position shown in FIG. 2, lever arm 62 permits button 64 to disengage switch 59 so as to create an open circuit configuration breaking the electrical connection between leads 58 and 60 (FIG. 6), thereby disconnecting power supply 40 from the remaining circuit elements within postage meter 11. In the solid line position shown in FIG. 2 during assembly of the meter, a latch 66 retains lever arm 62 in the depressed position to maintain switch 59 in a closed circuit configuration.

Assembly of the remaining elements of meter 11 within housing 10 is completed and a retaining member in the form of a mounting screw 68 is inserted through opening 70 in housing 10. Mounting screw 68 is threaded into an interior plate 72 mounted within housing 10. Insertion of mounting screw 68 during final assembly dislodges latch 66 while maintaining lever arm 62 in the closed circuit position. Latch 66 falls to the solid line position shown in FIG. 2. Mounting screw 68 has a threaded portion which engages mounting plate 72 and a shaft portion 74 which forms a journalled surface about which handle 14 and shutter portion 16 rotates at pivot point 18.

When screw 68 is fully inserted into mounting plate 72 a protective cap 80 which engages opening 70 in housing 10 is mounted within opening 70 and retained therein by flange 75. Cap 80 is formed of a breakable material and mounting head 76 of screw 68 is formed with a sharp cutting edge 79 which permits breaking of the mounting cap 80 by means of a hand tool such as a screwdriver. Cutting edge 79 completes the breaking of cap 80 when mounting screw 68 is withdrawn from opening 70.

When a malfunction of the postage meter 11 is encountered, it is desired to read out the contents of memory register 24 in order to immediately transfer the postal balance in the inoperative meter to a replacement meter, thereby avoiding a lengthy delay during repair of the malfunctioning meter. It is desired at this point to able to access the memory register 24 while maintaining security of the accounting information in memory 24. Accordingly, a hand tool is employed to break cap 80 and to disengage mounting screw 68 from plate 72. When mounting screw 68 is disengaged from mounting plate 72 and withdrawn from housing 10, lever arm 62, which is spring loaded, moves to the dotted line position shown in FIG. 2 and thereby opens switch 58 to provide an open circuit condition which disconnects the electronic components within housing 10 from power supply 40. Handle 14 may then be removed from housing 10 through slot 12 thereby removing shutter 16 from its location blocking aperture 20. Access is thus provided for probe 28 through aperture 20 in housing 10 and opening 73 in plate 72 to engage communication channel 26 on printed circuit board 22 to permit readout of the memory register 24.

Aperture 20 has mounted therewithin a mounting plate 90 as shown in FIG. 3 and pressing of the probe against element 90 moves it inwardly so that it may drop to the interior of housing 10. Aperture plate 90 is retained in its position by handle 14 and shutter portion 16 and thus may not be removed until handle 14 is removed. Thus a visual indication is provided that access through aperture 90 has been provided. Further, the destruction of cap 80 provides an additional visual indication that handle 14 has been removed and that the switch 56 is in the open circuit configuration. Thus a knowledgeable repair person or postal service employee can detect that the meter 11 is capable of being or has been accessed to readout its memory register.

It will be noted that withdrawal of mounting screw 68 which permits switch 59 to move to the open circuit configuration disables the postage meter. Since latch arm 62 has moved to the dotted line position which is the open circuit configuration, reinsertion of mounting screw 68 will not re-engage the switch 59 to close the circuit. Thus only destruction of the secured housing (and possibly the meter itself) will permit movement of the switch 58 to the closed circuit configuration permitting further operation of the meter.

In recapitulation, it will be seen that an electronic postage meter has been provided with a security system such that transfer of the accounting information contained in the nonvolatile memory can be made at the postal service location without the lengthy delay usually required while the meter is returned to a repair location and then taken to the postal service for recharging and resetting. It will be seen that this access is permitted in a secure fashion which disables the meter for further use thereby preventing unauthorized changing of the contents of the nonvolatile memory or operation of the meter and postage printer.

It is therefore evident that there has been provided in accordance with the present invention a security system for an electronic device that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all such alternatives, modifications and variations that follow within the spirit and scope of the appended claims.

What is claimed is:

1. An electronic calculating device comprising a memory means having accounting information registered thereon, a control means for calculating the accounting information and entering the information into the memory means, a power supply providing power to the control means, a switch means having a first position in which an electrical connection is provided between the power supply and the control means and a second position in which the power supply is disconnected from the control means, the switch being in the first position during normal operation of the calculating device, a secured housing enclosing the memory means, the control means, and the switch means and preventing access thereto during normal operation of the calculating device, and an aperture in the housing permitting access to the memory means to read out accounting information registered thereon, wherein movement of the switch from the first position to the second position to disconnect the control circuit from the power supply disables the calculating device from further normal operation but permits readout of the accounting information through the aperture.

2. An electronic calculating device comprising a nonvolatile memory having accounting information registered thereon, a control circuit for calculating the accounting information and entering the information into the nonvolatile memory, a power supply providing power to the control circuit, a two position electrical switch having a first switch position which provides a completed circuit from the power supply to the control circuit and a second switch position in which the circuit from the power supply to the control circuit is disconnected, the switch being in the first position during normal operation of the calculating device, a secured housing enclosing the nonvolatile memory, the control circuit and the switch and preventing access thereto during normal operation of the calculating device, and an access aperture in the housing permitting access to the nonvolatile memory to read out accounting information registered thereon, wherein use of the access aperture causes the switch to move from the first position to the second position to disconnect the control circuit from the power supply thereby disabling the calculating device from further normal operation.

3. An electronic calculating device as set forth in claim 2 and further including a shutter within the housing, the shutter preventing access to the interior of the housing through the aperture, and a retaining member having a first position for retaining the shutter in an access preventing position and retaining the switch in the first position, movement of the retaining member from the first position permitting movement of the shutter from the access preventing position and causing movement of the switch from the first position to the second position.

4. An electronic calculating device as set forth in claim 3 and further including a carrying handle mounted on the housing, the handle being movable between a first inoperative position and a second operative position permitting lifting of the housing, the shutter being integrally connected to the handle such that movement of the handle between the first and second position maintains the shutter in the access preventing position.

5. An electronic calculating device as set forth in claim 4 wherein the retaining member retains the handle in the first and second operating positions and movement of the retaining member from the first position permits detachment of the handle and shutter from the housing to provide access to the interior of the housing as well as a visible indication that such access has been provided.

6. An electronic calculating device as set forth in claim 5 wherein the nonvolatile memory includes a communication channel which permits readout of data contained in the memory, but prohibits writing of data into the memory and wherein the access aperture permits insertion of an electronic probe for electrical connection to the communication channel of the nonvolatile memory.

7. An electronic postage meter comprising a nonvolatile memory having postage funds accounting information registered thereon, a control circuit for calculating the accounting information and entering the information into the nonvolatile memory, a power supply providing power to the control circuit, a two position electrical switch having a first switch position which provides a completed circuit from the power supply to the control circuit and a second switch position in which the circuit from the power supply to the control circuit is disconnected, the switch being in the first position during normal operation of the postage meter, a secured housing enclosing the nonvolatile memory, the control circuit, and the switch and preventing access thereto during normal operation of the postage meter, and an access aperture in the housing permitting access to the nonvolatile memory to read out postage funds accounting information registered thereon, wherein movement of the switch from the first position to the second position to disconnect the control circuit from the power supply thereby disables the postage meter from further normal operation while permitting read out of the postage funds accounting information from the memory through the aperture.

8. An electronic postage meter as set forth in claim 7 and further including means preventing movement of the switch from the second position to the first position.

9. An electronic postage meter as set forth in claim 8 wherein the nonvolatile memory includes a communication channel which permits read out of postage accounting data from the memory but precludes writing of data into the memory and wherein the access aperture permits insertion of an electronic probe for electrical connection to the communication channel.

10. An electronic postage meter as set forth in claim 9 and further including means associated with the housing for providing a visual indication that access to the interior of the housing has been provided.

* * * * *